United States Patent [19]

de Pingon

[11] 4,417,844

[45] Nov. 29, 1983

[54] AUTOMATIC TOOL MOUNTING FOR EXCAVATORS, LOADERS, GRADERS AND THE LIKE

[76] Inventor: Pierre J. de Pingon, 7 avenue du Parmelan, 74000 Annecy, France

[21] Appl. No.: 229,927

[22] Filed: Jan. 30, 1981

[30] Foreign Application Priority Data

Jan. 31, 1980 [FR] France ..... 80 02095

[51] Int. Cl.[3] ..... E02F 3/81

[52] U.S. Cl. ..... 414/723; 37/117.5; 172/275

[58] Field of Search ..... 172/272–275; 37/103, DIG. 3, 117.5; 414/726, 723, 686

[56] References Cited

U.S. PATENT DOCUMENTS

| | | | |
|---|---|---|---|
| 3,237,795 | 3/1966 | Kromer | 172/275 |
| 3,512,665 | 5/1970 | Westendorf | 414/723 |
| 3,718,222 | 2/1973 | Foster | 414/723 |
| 3,876,092 | 4/1975 | MacDonald | 414/686 |
| 4,251,181 | 2/1981 | Drott et al. | 172/273 X |

FOREIGN PATENT DOCUMENTS

| | | | |
|---|---|---|---|
| 882328 | 5/1953 | Fed. Rep. of Germany | 172/275 |
| 2408989 | 7/1979 | France | 172/275 |
| 216635 | 10/1967 | Sweden | 414/723 |
| 563701 | 7/1975 | Switzerland | 172/272 |

*Primary Examiner*—Robert J. Spar
*Assistant Examiner*—Terrance L. Siemens
*Attorney, Agent, or Firm*—Young & Thompson

[57] ABSTRACT

An automatic tool holder for tools such as buckets, scoops and the like, for mounting on equipment such as graders, back hoes, excavators, chargers, etc. The tool and tool holder are provided with mating sets of lugs and recesses, one set being disposed on each of the tool and tool holder. The lugs and recesses are offset from each other in three dimensions, for strength and stability and also to permit free disengagement of the tools from the tool holder by relative movement in one direction. A spring-urged locking lever on one of the tool or tool holder snaps behind a corresponding locking abutment on the other of the tool or tool holder, when the lugs are fully engaged in the recesses, to retain the tool in assembled relation. A fluid-actuated jack is selectively operable to swing the lever out of locking position, to release the tool.

1 Claim, 2 Drawing Figures

AUTOMATIC TOOL MOUNTING FOR EXCAVATORS, LOADERS, GRADERS AND THE LIKE

Figures 1, 2:
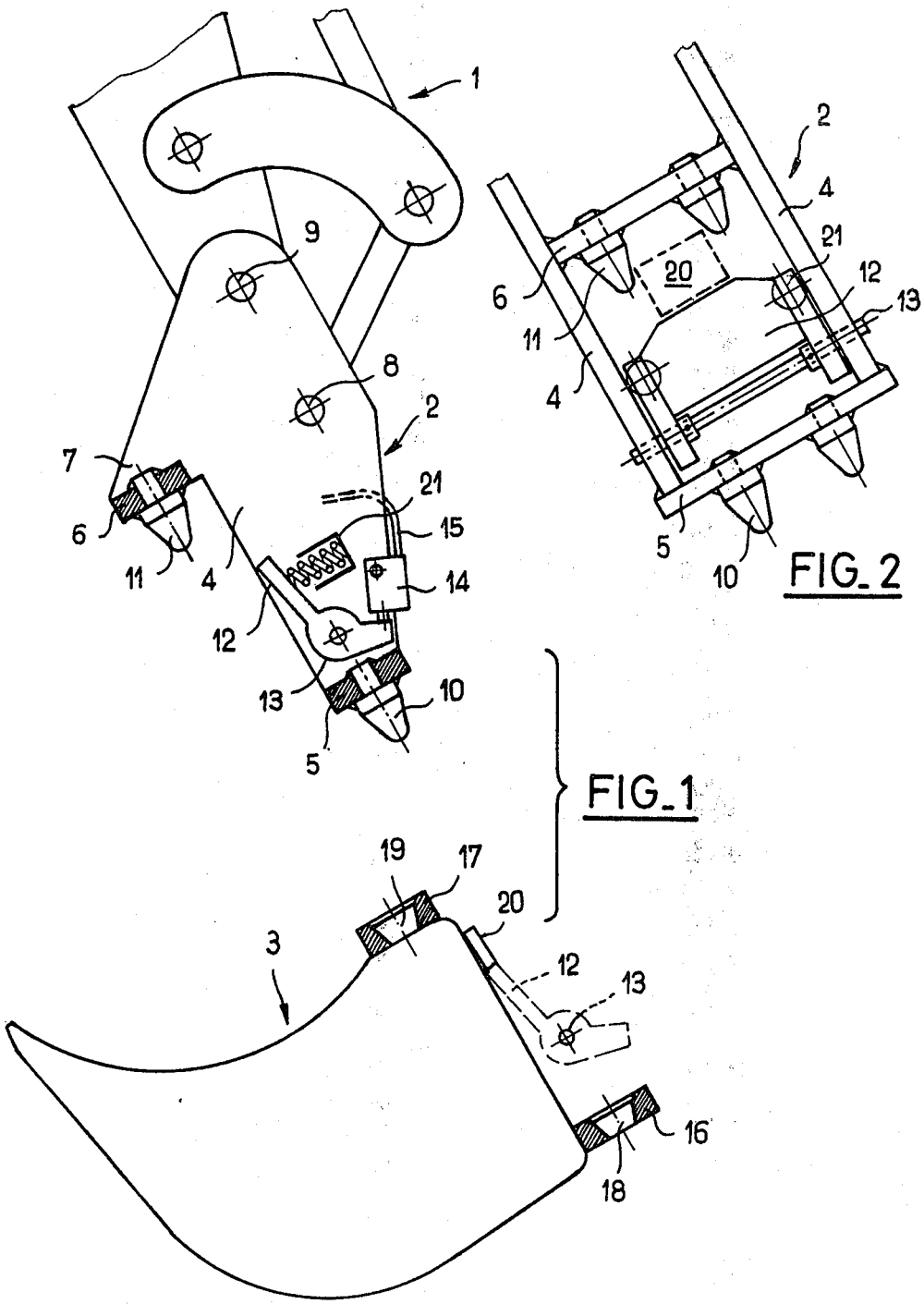

The present invention relate to public works machinery or the like.

The changing of working tools, such as buckets, scoops, blades, or the like, on public works machinery such as graders, back hoes, excavators or the like, is a difficult and time-consuming operation. The buckets or other tools are heavy, the pivotal axles are large to resist the forces involved, and the tool changing operation must often be performed under adverse conditions in the field.

An object of the present invention is accordingly to overcome these difficulties, by providing an automatic tool holder for the working end of the equipment, enabling the operator, from his cab, to install or remove quickly a tool of his choice.

The invention is quickly and easily adaptable to all kinds of equipment with only a small minor modification thereof.

The invention thus comprises an automatic tool holder for excavators, loaders, graders, back hoes or the like, characterized in that it comprises a tool holder adapted for mounting on the working end of the machinery and comprising at least two sets of at least two lugs or the like or holes or the like; and a locking member which is normally urged toward a locking or working position and means for selectively moving this locking member from its working position. The lugs are mounted on the tool holder or the tool, the holes being carried by the other of the tool holder or tool in corresponding positions thereon. Similarly, the locking lever is carried by the tool holder or the tool, on the other of which is provided an abutment with which the locking lever releasably engages to keep the lugs and holes from separating from each other.

According to a preferred embodiment, the tool holder has two lateral plates interconnected by transverse members, and the lugs or holes are positioned in laterally spaced relationship on these transverse members. Also according to a preferred embodiment, the transverse members are laterally offset from each other, that is, they do not vertically overlie each other perpendicular to their planes, so that the tool can drop away vertically from the tool holder without interference from these transverse bars. At the same time, the transverse bars reinforce the laterally spaced plates, providing a rigid and strong rectangular framework for the tool holder.

Preferably, the lateral displacement of the bars from each other, their spacing from each other in a direction perpendicular to their plane, the spacing between the side plates of the tool holder, and the distance between the lugs and hence between the holes, in all directions, are substantial, thereby to increase the strength and rigidity of the device and of the mounting of the tool on the tool holder.

Preferably, the tool holder is mounted on the equipment for compound vertical swinging movement about two axes, according to known techniques which as such accordingly from no part of the present invention.

In another preferred embodiment, the locking member is a two-armed lever mounted pivotally between its ends for vertical swinging movement between the lateral plates of the tool holder and subjected to the action of a spring which urges it toward its locking position in which it engages by one of its arms on an abutment fixed to the tool. A fluid-operated jack connected to the fluid operating circuit of the machine permits actuation of the lever to control positively its unlocking, and also, if desired, its locking.

To mount the tool, it suffices that the operator of the machine brings the machine by the usual manipulatory movements, into a position in which the lugs engage in the corresponding recesses. If desired, the locking lever can be positively manipulated at this time; otherwise, it will act automatically, snapping into position behind its corresponding abutment under the action of its associated spring.

To free the tool, the operator acts on the locking lever to disengage it from its corresponding abutment, after which the tool holder is removed, leaving behind the disengaged tool.

Other objects, features and advantages of the present invention will become apparent from a consideration of the following description, taken in connection with the accompanying drawing, in which:

FIG. 1 is an exploded schematic fragmentary side view, showing the automatic tool holder of the present invention; and FIG. 2 is a fragmentary front view of the base portion thereof.

In FIG. 1, there is indicated generally at 1 the operating equipment of a machine of known type, such as an earthworking machine, for example a grader, back hoe, trencher, etc. (not shown). A tool holder 2 is provided, for detachably receiving a bucket 3 or other tool.

In the illustrated embodiment, the tool holder 2 comprises two spaced parallel side plates 4 interconnected by transverse members 5, 6 in the form of heavy bars. Crosspiece 5 is disposed toward the ends of plates 4 remote from the machine, while plate 6, which is offset relative to 5, connects to tongues 7 formed by recessing the plates 4 and providing a downwardly opening recess. As indicated schematically in FIG. 2, the crosspieces 5, 6 may be welded to plates 4 so as to form a strong and rigid assembly.

This assembly is mounted on the machine on axles 8 and 9 for pivotal movement about those axles under the influence of the usual power operated linkage, which is entirely conventional and hence need not be further described.

Each crosspiece 5, 6 carries two conical lugs 10, 11 each of which has a rearwardly projecting pin or tail that is received in a hole of the same diameter in the corresponding crosspiece 5 or 6 and welded in place. The accurate positioning of the holes for the lugs on the crosspieces is very important and is effected with the aid of a template.

A two armed locking lever 12 is pivotally mounted between the plates 4 about an axle 13 and is urged by a coil compression spring 21 counterclockwise as seen in FIG. 1. This pivotal movement is limited by a small hydraulic or pneumatic jack 14, which also controls the pivotal movement of locking lever 12 in a clockwise direction as will be described later. Fluid supply to jack 14 is from the fluid supply circuit of the machine indicated only partially at 15. It can thus be controlled from the operator's cab.

In the illustrated embodiment, bucket 3 is provided with transverse bars 16, 17 which are of substantial size and are welded in place and which are provided with conical holes 18, 19, two for each bar. Their size, shape and spacing correspond to that of lugs 10, 11 on the tool carrier, to receive the latter precisely in the four holes thus provided, the relative conical shapes of the holes and lugs assisting in this engagement.

An abutment in the form of a bar 20 is also welded on bucket 3 in a position such that, when bucket 3 moves to the upper left as seen in FIG. 1, into a position in which the lugs 10, 11 seat fully in holes 18, 19, respectively, the locking lever 12 will just snap behind bar 20, as shown in phantom line in FIG. 1.

The operation of the device is as follows:

With the bucket 3 resting on the ground, the equipment operator controls the equipment 1 in the usual way so as to bring lugs 10, 11 into confrontation with holes 18, 19, and then to fit them into the holes. During this operation, the operator controls jack 14 to extend its piston to swing locking lever 12 clockwise. When the lugs 10, 11 are engaged in the holes 18, 19, the operator frees jack 14 and thus lever 12, which is urged by spring 21 counterclockwise to the phantom line position shown in FIG. 1. In this condition, the bucket 3 is maintained fixedly in mounted arrangement on the machine, by the four lugs 10, 11 which cannot be disengaged, thanks to locking lever 12 which, as previously indicated, has engaged behind abutment bar 20.

It is also possible, during this engagement operation of the tool, to leave locking lever 12 free to move, without acting positively upon it by the jack 14. At the time of engaging the lugs 10 and 11 in the holes 18 and 19, lever 12 will be swung clockwise by its engagement with abutment 20, in this latter case, until it snaps under abutment bar 20 in the phantom line position as shown in FIG. 1, without the aid of jack 14.

To free tool 3 from the equipment, the operator lowers the tool, in this case the bucket 3, to the ground, and then actuates jack 14 to swing locking lever 12 clockwise out of engagement with the abutment bar 20. The operator then raises the equipment, at which time the lugs 10, 11 disengage easily from the holes 18, 19, leaving the tool on the ground.

It is to be noted that all of these operations may be controlled from the operator's cab of the equipment or from the driver's seat and that the locking and unlocking of the tool are automatically effected.

Modifications may be made in the described embodiment, without departing from the invention. Thus, as previously indicated, the lugs and corresponding recesses may be reversed, the lugs being then provided on the tool while the recesses are provided on the tool carrier. In each case, such modifications are minor and easy for use with existing tools and equipment so as to practice the present invention. Moreover, the machine itself need not be modified.

From a consideration of the foregoing disclosure, therefore, it is evident that the initially recited objects of the present invention have been achieved.

What is claimed is:

1. For use with an excavator, charger, grader or the like, the combination of a tool holder and a tool, at least two sets of at least two lugs each, fixedly secured on one of the tool holder and tool, means providing matching recesses for the lugs on the other of the tool holder and tool, a locking member on one of the tool holder and tool, an abutment on the other of the tool holder and tool behind which the locking member locks when the lugs are fully seated in the recesses thereby to maintain the lugs fully seated in the recesses, and means for selectively disengaging the locking member from behind the abutment, all the lugs and the axes of all the recesses being parallel to each other so that all the lugs are simultaneously engageable in the recesses by relative movement of the tool holder and tool in a single direction, the tool holder comprising two spaced parallel plates interconnected by spaced transverse members, said lugs or recesses being disposed in spaced relationship along said transverse members between the planes of said plates, said transverse members being flat bars that are spaced apart in a direction perpendicular to the bars and are also laterally offset in a direction parallel to the plane of the bars but perpendicular to the length of the bars.

* * * * *